United States Patent [19]

Colledge et al.

[11] Patent Number: 4,856,775

[45] Date of Patent: Aug. 15, 1989

[54] PORTABLE MULTI-PURPOSE EXERCISE DEVICE

[76] Inventors: Alan L. Colledge, 35 E. 400 North, Lindon, Utah 84042; Hugh I. Johnson, 637 E. 875 North, American Fork, Utah 84003

[21] Appl. No.: 85,194

[22] Filed: Aug. 14, 1987

[51] Int. Cl.[4] ..... H63B 21/00

[52] U.S. Cl. ..... 272/134; 272/DIG. 4; 272/144; 272/72; 272/73; 272/136

[58] Field of Search ..... 272/116, 134, 144, DIG. 4, 272/136, 145, 73, 93

[56] References Cited

U.S. PATENT DOCUMENTS

| | | | |
|---|---|---|---|
| 2,855,200 | 10/1958 | Blickman | 272/73 |
| 3,226,115 | 12/1965 | Underhill | 272/145 X |
| 3,342,485 | 9/1967 | Gaul | 272/145 |
| 4,140,312 | 2/1979 | Buchmann | 272/73 |
| 4,492,375 | 1/1985 | Connelly | 272/134 |
| 4,564,194 | 1/1986 | Dawson | 272/134 X |
| 4,609,192 | 9/1986 | Bratcher | 272/144 |
| 4,667,955 | 5/1987 | Giesch | 272/134 X |
| 4,709,923 | 12/1987 | Gibson | 272/134 |

OTHER PUBLICATIONS

Soloflex; 1981.

Popular Science; pp. 92 & 93; Muscle Toning Workout; Aug. 1983.

*Primary Examiner*—Richard J. Apley

*Assistant Examiner*—H. Flaxman

[57] ABSTRACT

A portable, multi-configurable exercising device which allows a full range of exercises to be performed in correct fashion on a compact, light-weight apparatus. All components are contained in a case which reconfigures in such a way as to form an exercise platform. Several components are adjustably attachable to the platform via a fastening device thereby creating multiple embodiments and allowing the performance of many exercises.

1 Claim, 6 Drawing Sheets

PORTABLE MULTI-PURPOSE EXERCISE DEVICE

Figure 1:
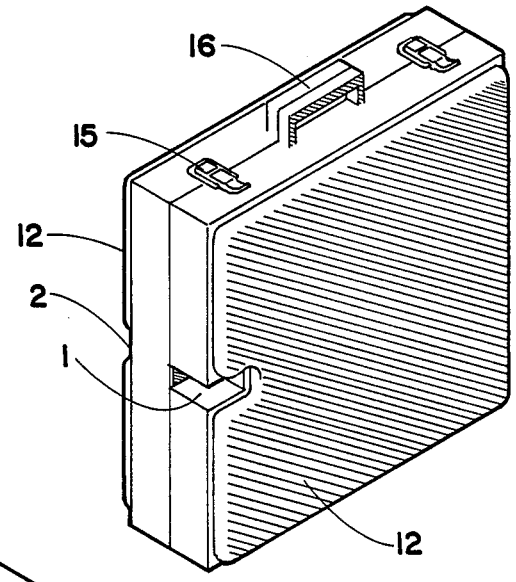

Current interest in personal health and physical fitness has helped create a strong demand for compact, sturdy, inexpensive home exercise equipment capable of allowing users to perform the wide range of exercises considered essential in a complete fitness program. A number of exercise devices have been previously developed which attempt to meet this need. However, most such devices are either too cumbersome for practical use and storage in the average home or else they are too limited in the variety of exercises they allow a user to perform. Additionally, many of these devices lack the sturdiness and durability required for serious long-term usage.

For example, LaLanne, U.S. Pat. No. 2,647,209 discloses a multi-purpose device featuring a frame supported cable which facilitates the lifting of a selectable number of weight plates contained within the frame. Nist, U.S. Pat. No. 3,734,495, discloses a similar device designed especially for exercising the lower extremities. Another similar device is shown in Uyeda, U.S. Pat. No. 4,317,566, featuring a vertical column guide which allows users to lift weight plates via a carriage to which is attached an extended lifting arm. These and other similar devices do not allow users to properly exercise all major muscle groups and, because of their need to contain a mass of weight plates within their framework, are too cumbersome to allow the portability required for use in the typical home.

A type of exercise device designed especially to provide means for cardiovascular (aerobic) workouts is disclosed by Gulland, U.S. Pat. No. 3,381,958. This device consists of a vertical frame member to which are connected sets of adjustable hand and foot pedals. Similar devices are disclosed by Wiley, in U.S. Pat. No. 4,353,544 and by Zimmerman, U.S. Pat. No. 4,225,130. These devices provide means for aerobic exercise utilizing both the upper and lower extremities through rotation of the pedals but do not effectively allow the performance of other types of exercise. Additionally, the Gulland and the Wiley devices are of limited portability.

Another type of exercise device disclosed in Lloyd, U.S. Pat. No. 3,664,666, is a portable case which folds out into an exercise board. Spring-loaded cables, located within the case, allow the performance of various exercises of the upper and lower extremities. Underhill, U.S. Pat. No. 3,226,115, and Miller, U.S. Pat. No. 481,730, demonstrate similar portability. However, none of these devices allow the user to perform a full complement of exercises. Additionally, both the Underhill and the Miller devices require them to be attached to a wall, a doorframe, or similar fixed structure for support while performing most of the exercises.

Furhop, U.S. Pat. No. 4,286,782, discloses another type of exercise device which is essentially a frame, configurable in several different ways, which enhances the user's ability to perform a range of individual exercises. This device, however, has an unusually large number of separate components which require assembling in order to complete each configuration. Additionally, the device requires the use of conventional barbells and free-weights. These features make it somewhat inconvenient for home use and storage.

Wilson, U.S. Pat. No. 4,702,309, discloses yet another type of exercising device consisting of a ground supported frame and a rigidly fixed vertical column. Means are provided for securing and adjusting a lever arm and an exercise bench to the column. The device also features attaching means for securing elastic cords which provide resistance to exercising movements. This device's design, however, allows a great amount of stress to be concentrated on the welds joining the various parts. A similar device, disclosed by Connelly, U.S. Pat. No. 4,492,375, features construction similar to the Wilson device but seeks to reduce the stress placed upon the welds securing the components which receive the force of the exercise movement. Nevertheless, the Connelly design still allows an undesirable amount of stress to be placed upon the weld securing the cylinders which provide support for the biasing means to the sleeve. Neither the Wilson nor the Connelly device allows the user to fully and properly exercise the lower extremities through such traditional exercises as leg curls and thigh extensions. Also lacking are traditional aerobic-type stations such as bicycling and rowing. Additionally, while being relatively compact, their weight and construction make them neither readily portable nor easily storable.

Accordingly, it is an object of the present invention to provide an exercise device which is light-weight, durable, compact, and fully portable, allowing for rapid assembly and ease in storing.

SUMMARY OF THE INVENTION

The objects of this invention are realized by an exercise device consisting of a case comprised of two similarly constructed halves, within which are contained all the components for assembling the various embodiments of the apparatus. The two halves of the case are removeably connected. Upon opening the case and separating the halves, they can be rigidly reconnected to form a ground-supported exercise platform. A multi-sectioned exercise bar is assembled and connected to the forward portion of the platform in a rigid, vertical position. In this positioin, the vertically positioned bar can receive a carriage to which is permanently and pivotally attached a lever arm through which the user interacts in performing exercises. The carriage/lever arm assembly includes means for allowing its secure attachment to the vertical bar at convenient positions. The carriage/lever arm assembly is equipped with fastening means for attaching circular elastic cords or other means of resistance which bias the lever arm against exercise movements.

In another embodiment, the exercise platform is elevated on the end to which the vertical bar is attached, the bar then being reattached at a point towards the midpoint of the bar, resulting in an inclined exercise platform supported at one end by the end of the exercise platform and supported at the other end by the end of the vertical bar. A knee support means and an ankle strap may also be attached which enhance the correctness of sit-up type exercises performed in this embodiment.

In yet another embodiment, the two halves of the case are left separated and disposed at an appropriate distance apart from each other on the floor or other flat surface. The sectioned bar is then connected to each of the two halves along a horizontal plane in a bridge-like fashion. To the now horizontal exercise bar may be connected a seat attachment and the carriage/lever arm assembly. With the lever arm attached so as to be disposed below the plane of the horizontal bar, exercises of the lower extremities may be performed against the elastic cords or other resistance as previously described. With the lever arm disposed so as to be above the plane of the horizontal exercise bar, rowing-type exercises may be performed against the aforementioned resistance. In this embodiment, a second carriage may also be attached to the horizontal bar. To this second carriage is permanently attached a wheel/pedal assembly including an adjustable resistance means for frictionally resisting rotation of the wheel via the pedals. This second carriage provides the user with the ability to perform bicycling exercises using either the upper or the lower extremities. As is readily apparent to one familiar with the art, the device allows for a number of combinations of embodiments providing optimum exercising capability. Further objects and advantages of the invention will become apparent from a consideration of the drawings and ensuing descriptions thereof.

DESCRIPTION OF ILLUSTRATIONS

FIG. 1. is a perspective view of the apparatus case showing certain features.

Figure 2:
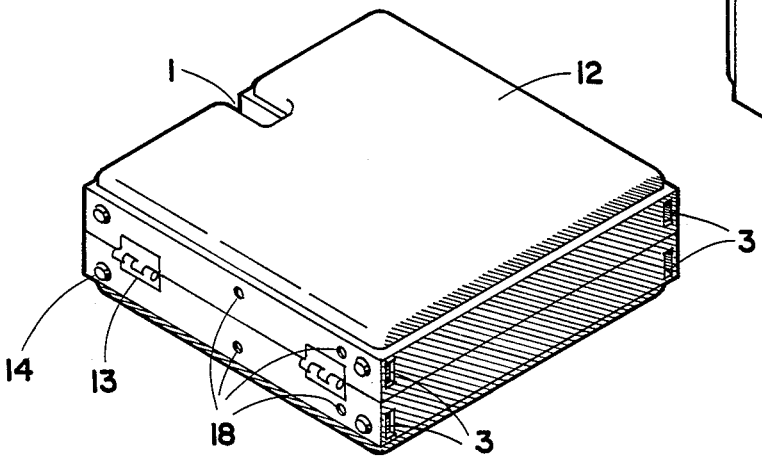

FIG. 2. is a perspective view of the apparatus case showing certain features.

Figure 3:
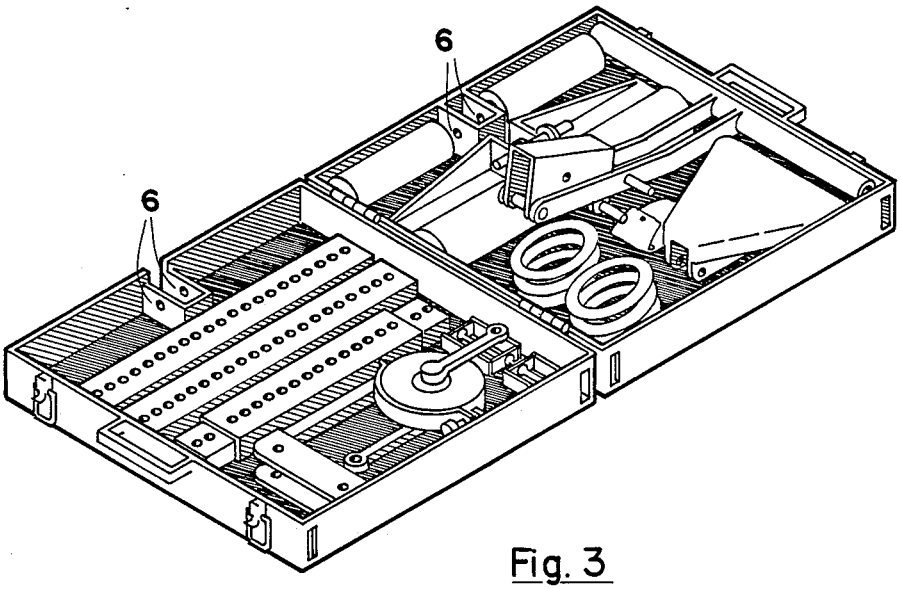

FIG. 3. is a perspective view of the apparatus and its components.

Figure 4:
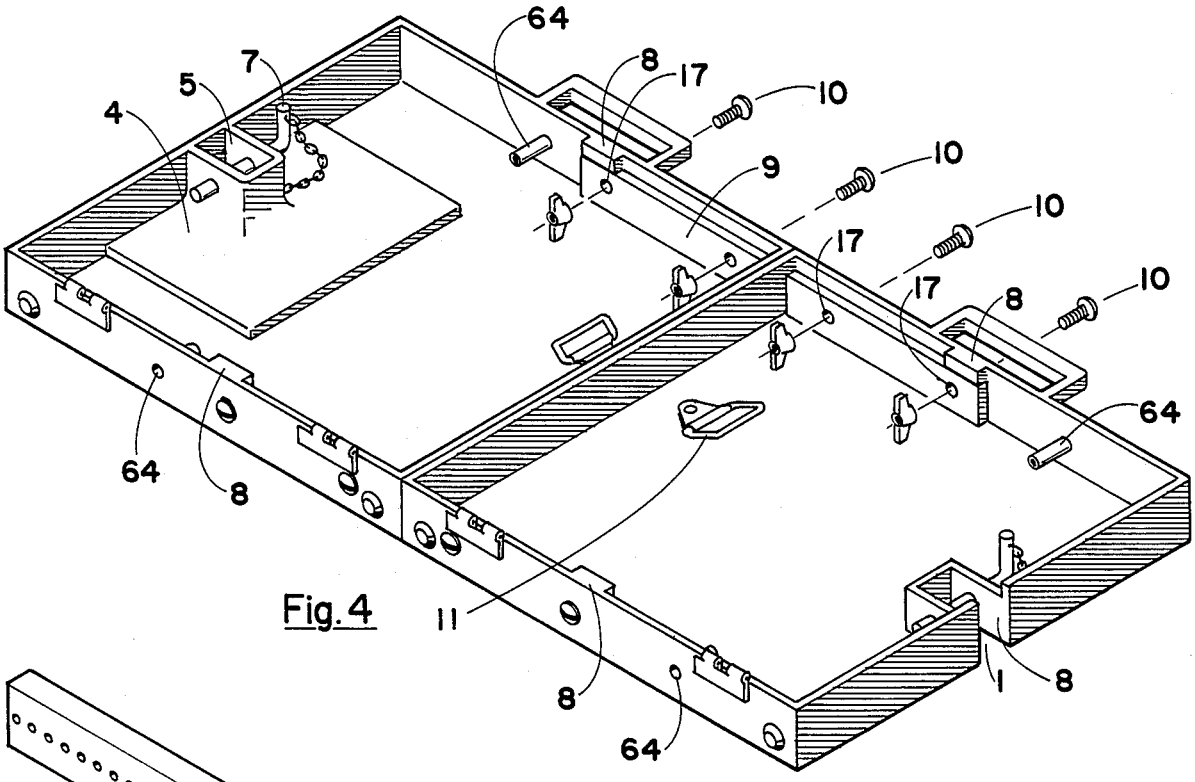

FIG. 4. is a perspective view of the insides of the case halves also showing the method of connecting the two case halves together.

Figure 5:
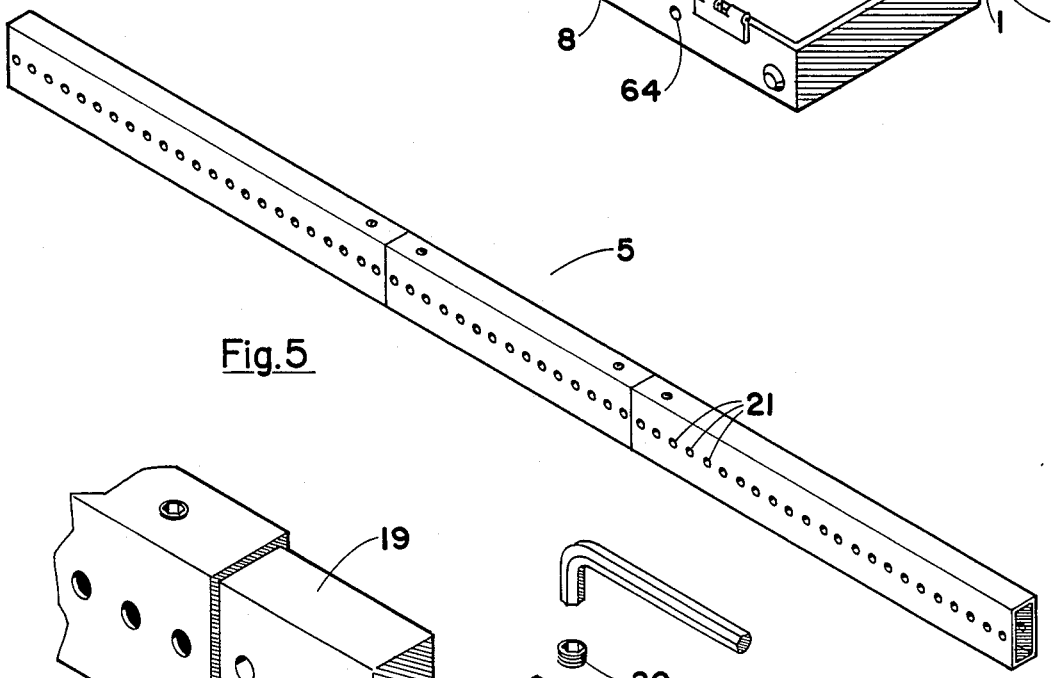

FIG. 5. is a perspective view of the exercise bar.

Figure 6:
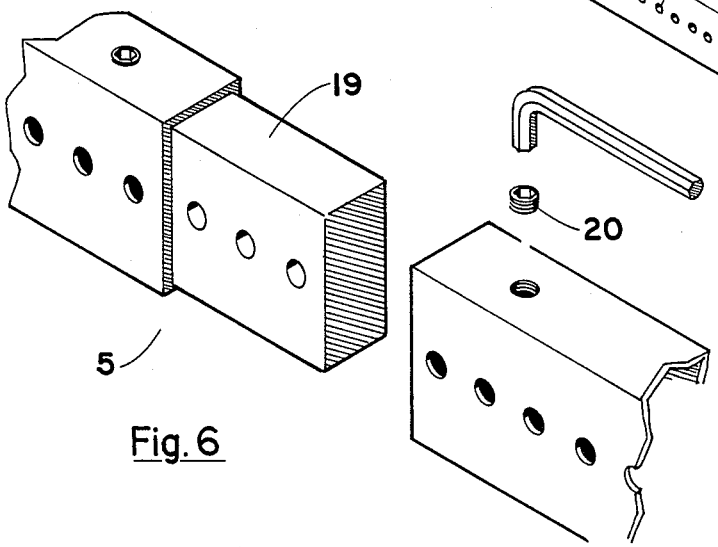

FIG. 6. is a sectional view of the exercise bar connection method.

Figure 7:
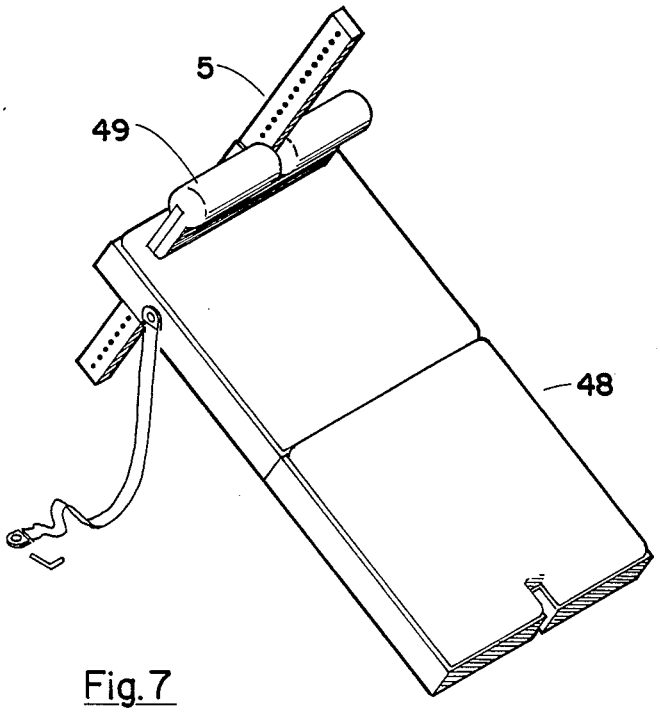

FIG. 7. is a perspective view of the apparatus in the inclined sit-up configuration.

Figure 8:
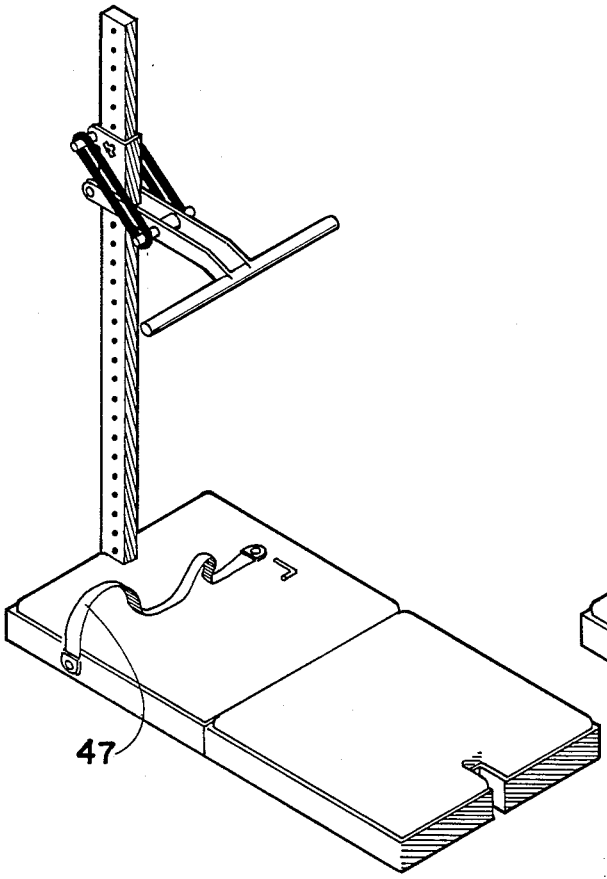

FIG. 8. is a perspective view of the apparatus in the upright configuration showing the carriage/lever arm biased against downward movement.

Figure 9:
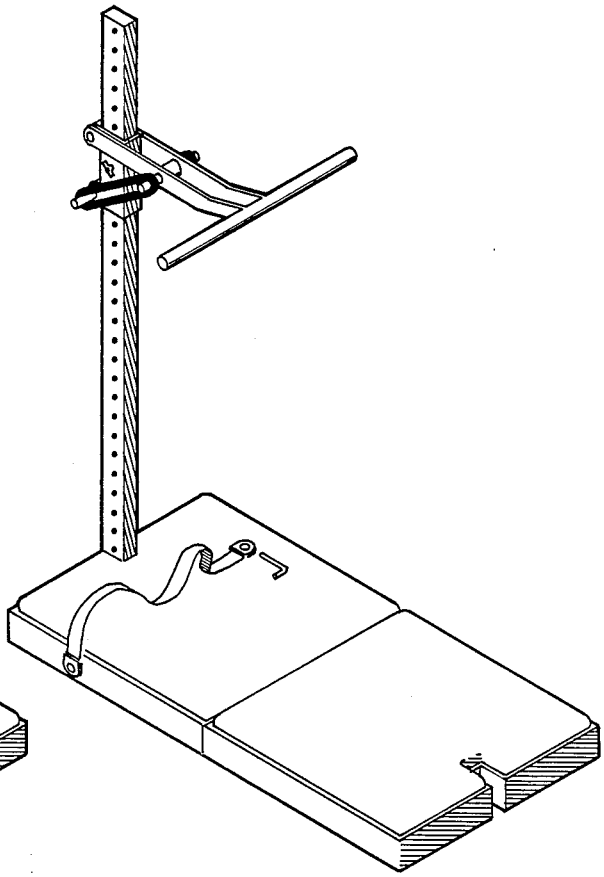

FIG. 9. perspective view of the apparatus in the upright configuration showing the carriage/lever arm biased against upward movement.

Figure 10:
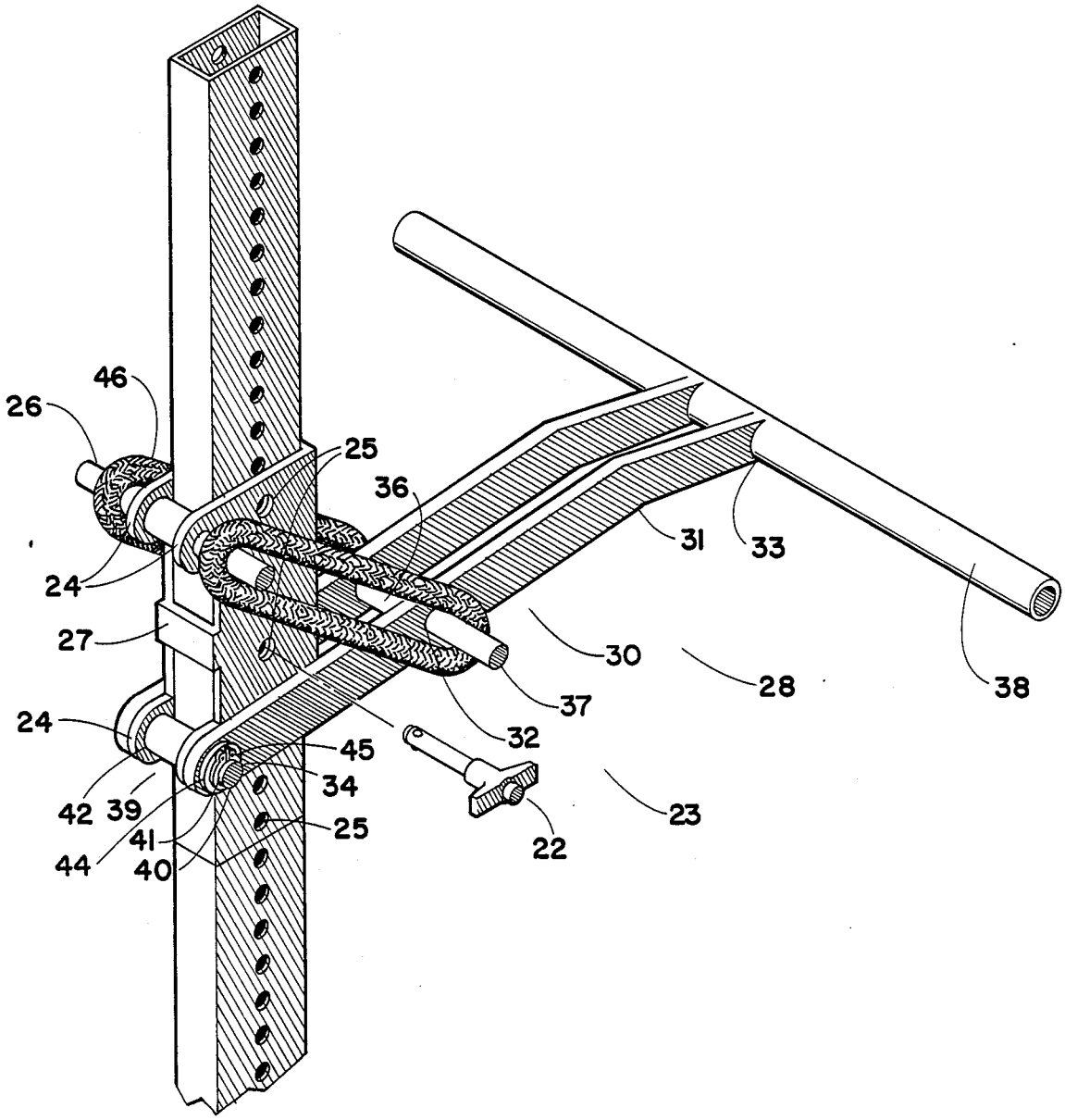

FIG. 10. is a portional view showing the elements of the carriage/lever arm assembly.

Figure 11:
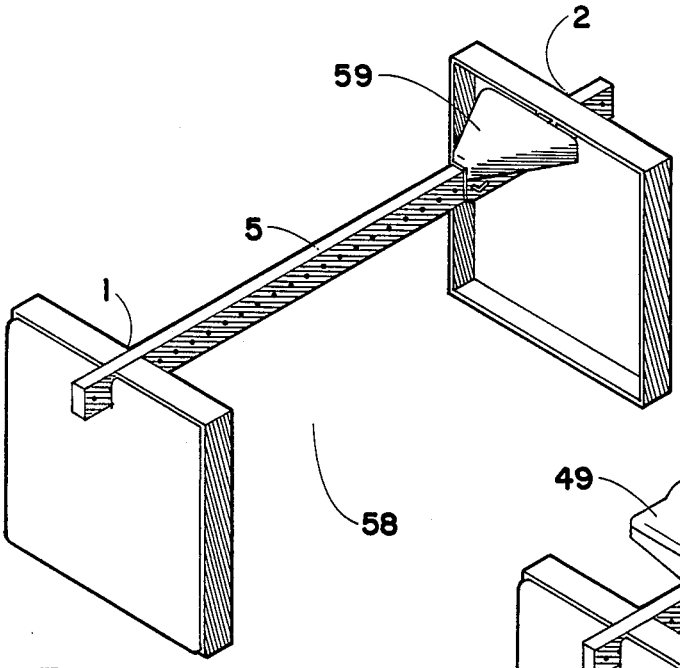

FIG. 11. is a perspective view of the apparatus in its basic horizontal configuration.

Figure 12:
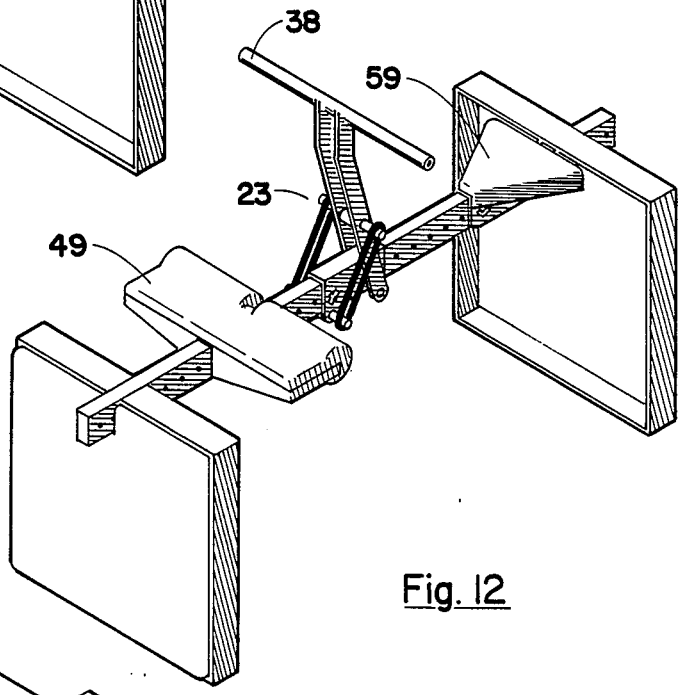

FIG. 12. is a is a perspective view of the apparatus configured to allow the performance of rowing exercises.

Figure 13:
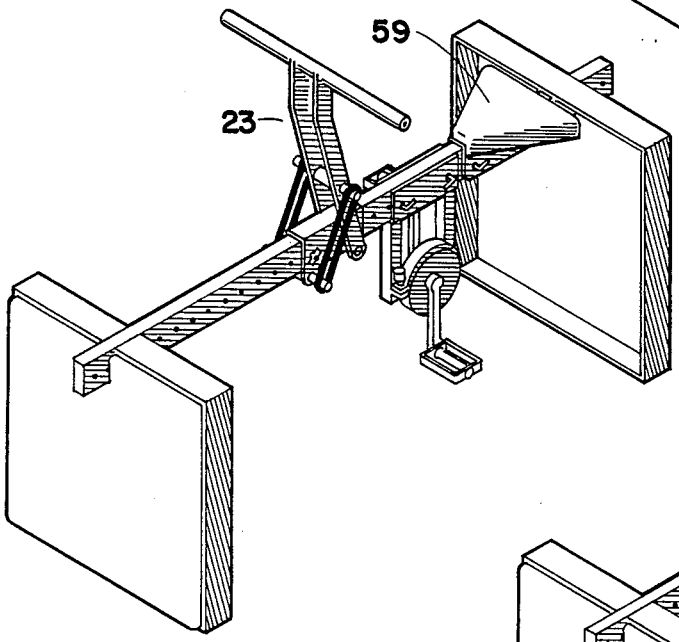

FIG. 13. is a perspective view of the apparatus configured to allow the performance of bicycling exercises.

Figure 14:
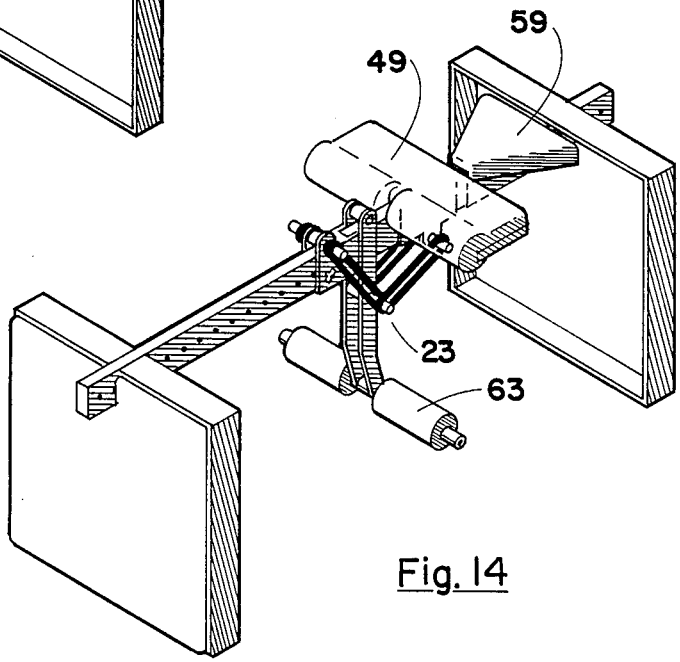

FIG. 14. is a perspective view of the apparatus configured to allow the performance of exercises of the lower extremities.

Figure 15:
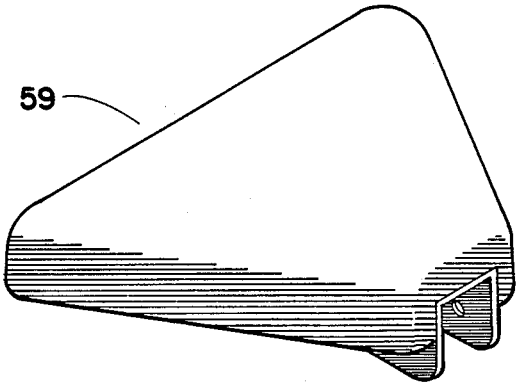

FIG. 15. is an upper perspective view of the seat component.

Figure 16:
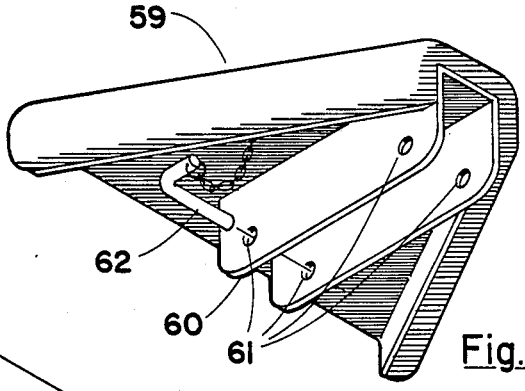

FIG. 16. is a lower perspective view of the seat component.

Figure 17:
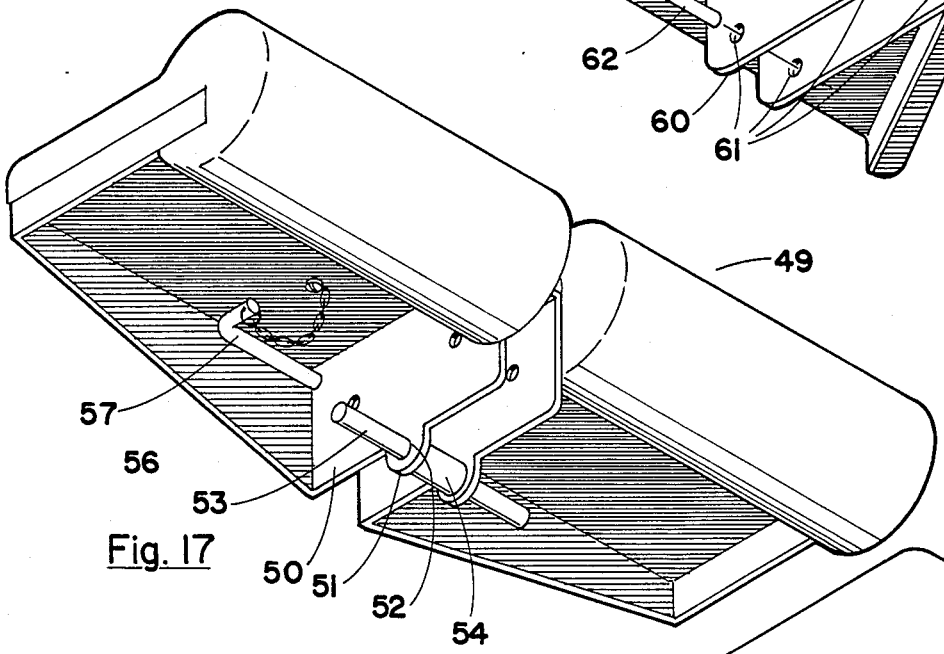

FIG. 17. is a lower perspective view of the knee support unit.

Figure 18:
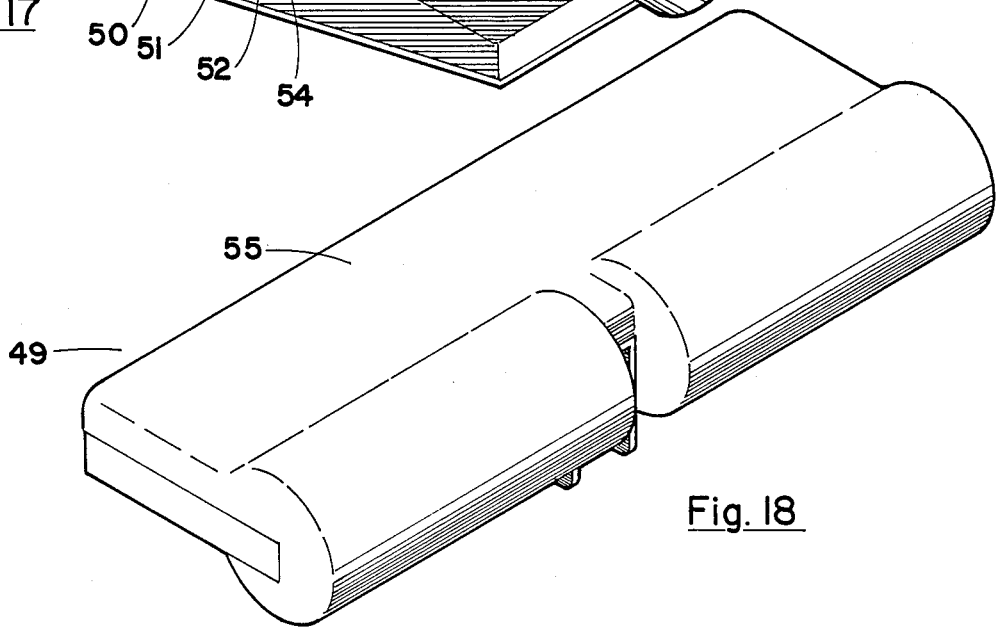

FIG. 18. is an upper perspective view of the knee support unit.

DESCRIPTION OF THE INVENTION

Referring to FIGS. 1, 2, & 3, the apparatus is seen as a compact, two-piece case within which are stored all of the device's components. The two case halves are similarly dimensioned and contructed so as to have four side walls and a large planar surface. Several openings, described hereinafter, are cut into the case halves including an open rectangular exercise bar support opening (1), a closed rectangular exercise bar support opening (2) (not shown), and connecting bar openings (3).

A closed exercise bar support (4) as seen in FIG. 4, is secured to the inside surface of one of the case's halves by welding and/or bolting. The closed exercise bar support is made from a single piece of cast aluminum and is essentially a rectangular block with flanges extending outwardly which engage the inner surface of the side wall and planar surface of the case half as shown. The center portion of the rectangular block is an opening (5) corresponding in dimensions to the closed exercise bar support opening (2). Through the closed exercise bar support opening (2) and opening (5), the closed exercise bar support (4) securely receives and supports an exercise bar, (5) in FIG. 5, further described hereinafter, and effectively distributes the force created when exercises are performed on the device as will be shown hereinafter. As best seen in FIG. 3, transverse, coaxial apertures (6) are drilled through the support which, when aligned with corresponding apertures in the exercise bar, allow the bar to be secured in a desired position by a pin fastening means.

The pin fastening means as seen in FIG. 4, consists of an L-shaped fastening pin (7) of circular cross section, which passes transversely through the aligned apertures in the exercise bar and the closed exercise bar support. To facilitate its accessability, the fastening pin (7) is attached to the support (4) by a narrow-diameter cable or small chain as shown.

An open exercise bar support (8), as seen in FIG. 4, is secured to the other case half's side wall at the open exercise bar support opening (1) by welding. The open exercise bar support comprises a U-shaped aluminum channel of dimensions which allow it to be essentially a continuation of the case half's side wall around the perimeter of the open exercise bar support opening (1). Welded into position, the open exercise support forms a saddle which supports the exercise bar (5) in certain embodiments of the device as described hereinafter. Also seen in FIG. 3, as with the aforementioned closed exercise bar support, transverse, coaxial apertures (6) are drilled through the side walls of the channel which, when aligned with corresponding apertures in the exercise bar, described hereinafter, allow the bar to be secured to the support via a pin fastening means as previously described.

It will become apparent that both the open and the closed exercise bar support openings must be fabricated to strict tolerances in order to maximize retention of the exercise bar.

Retaining pin receiving means (64) best seen in FIG. 4, are made by fitting short sections of circular aluminum tubing into apertures drilled into side walls of the case halves such that one end of the tube is flush with the outside surface of the side wall and the remainder of the tube is extending into the case half so as to be parallel to the square planar surface. Positioned as indicated, the tubing sections are secured by welding to the inner surfaces of the respective case halves. These pin receiving means ae used to support and passively retain pins which are used in various embodiments of the device as will be shown hereinafter.

Connecting bar retainers (8) are secured to the inner surface of the case halves' side walls by welding. The retainers, as seen in FIG. 4, are rectangular blocks of aluminum positioned on the side wall of the case halves so as to secure and support the connecting bars (9), when said connecting bars have been placed in position and fastened with the fastening screws (10) to rigidly connect the two case halves together as shall be described hereinafter. It will be apparent to one familiar with the art that the connecting bar retainers, along with the fastening screws (10) help to reduce stress from rotational forces that are placed on the connecting bars when exercises are performed on the device as described hereinafter. Steel swivels (11) as seen in FIG. 4 are bolted to the inside surface of the case halves and are used to help secure the devices components during storage. Vinyl-covered foam pads (12), as seen in FIGS. 1 and 2, are secured to the large planar outer surfaces of the case halves by riveting and/or gluing. These pads provide comfort to the user during exercises.

As shown in FIG. 2, hinges (13) are fastened to side walls of the case halves connecting the two case halves. The hinges are of the commercially available, removable type and allow the case halves to be easily disconnected and reconnected. Also shown are circular, rubber-headed screw bumpers (14) which act as support feet to protect the hinges. Clasps (15) as seen in FIG. 1 are attached to side walls of the case halves and engage so as to hold the case halves securely together during storage and transport. Handles (16) are also secured to the case halves to facilitate transport of the device.

FIG. 4 shows the method of connecting the case halves together to form an exercise platform. The case halves have been separated by releasing the clasps (15) and hinges (13) and the device's components have been removed. The case halves have then been rigidly reconnected by placing them open-side up on a floor or other flat surface, butting the appropriate side walls together, and connecting the case halves via the connecting bars (9) and fastening screws (10).

Attachment of the connecting bars is accomplished by passing one bar through the now aligned connecting bar openings (3) on either end of corresponding side walls of the case halves such that half of each bar lies within both cases and is positioned so as to bear on the connecting bar retainers as seen in FIG. 4. Apertures (17) in the connecting bars are aligned with apertures (18) as seen in FIG. 2 in the cases' side walls and fastening screws (10) with wing nuts are then employed through said apertures to secure the connecting bar into position and securing the two case halves together. The case halves now form a ground supported exercise platform from which many exercises may performed after attaching the device's components.

Most embodiments of the device require the attaching of an exercise bar to the platform or other configuration of the case halves. Referring to FIGS. 5 and 6, the exercise bar (5) is made in three sections to facilitate storage within the case. The sections are fabricated from aluminum tubing of rectangular cross-section and are connected by means of inner sleeves (19) and secured by Allen screws (20) or other means. The exercise bar contains a plurality of transversely drilled, coaxial apertures (21) which are employed to connect the bar to the exercise platform via the pin fastening means, as previously described, and also to secure the exercise device's components at convenient positions along the bar via a quick-release pin fastening means to be described hereinafter. The exercise bar (5) is placed into position by inserting it vertically into the closed exercise bar support and passing the retaining pin (7) through the aligned apertures in the exercise bar support openings (6) and in the exercise bar (21).

Many exercises also require the attachment of a carriage/lever arm attachment to the device. As best seen in FIG. 10, the carriage/lever arm assembly (23) is fabricated from aluminum channel, generally U-shaped, having ears (24) through which transverse, coaxial apertures are drilled. Transverse, coaxial apertures (25) are also drilled in the sides of the channel so as to be alignable with apertures in the exercise bar and through which the assembly is fastened to the exercise bar via a quick release pin fastening means. The quick-release pin fastening means consists of a push-button, quick-release pin (22), commercially available, which passes transversely through the aligned apertures in the exercise bar. A fixed securing pin (26) of circular cross section is passed through two opposing apertures in the carriage's ears (24) and is secured to the carriage by welding. Retaining member (27) consisting of a rectangular section of aluminum sheet of the same thickness as that of the channel is welded across the open channel so as to enhance the retention of the carriage/lever arm assembly to the exercise bar. The lever arm (28) consists of two identical aluminum bars each having straight portion (30), angled portion (31), and coaxial apertures (32)(33) and (34). Through apertures (32), a securing pin (37) is passed, also passing through an aluminum spacer sleeve (36). Securing pin (37) and spacer sleeve (36) are attached to the lever arm by welding. Through apertures (33), a hollow, circular, aluminum lever-arm handle (38) is secured centrally to the lever arm bars as shown by welding. Thus fabricated, the lever arm (28) is attached to the carriage by a pivot pin assembly (39). The pivot pin assembly consists of a pin (40) having a flat head (not shown) on one end and being circumferentially slotted (41) on the opposite end. The pin passes through apertures (34) on the lever arm bars and through aperture (42) in the carriage. Washer (44) is attached and snap ring (45) clips into the circumferential slot (41) to secure the entire assembly. The carriage/lever arm assembly is attached to the exercise bar by sliding it over the end of the exercise bar and securing it with the quick-release pin (22) through the aligned apertures in the exercise bar (21) and in the carriage assembly (25) as shown. The quick release pin is easily removed and replaced which aids the user in making position adjustments of the carriage/lever arm.

Referring again to FIG. 9, configured as shown the device can be biased against upward movement. Recommended biasing means consists of circular elastic cords (46) placed over pins (26) and (37). These commercially available cords are made from endless elastomer strands enclosed in a woven fabric covering and are available in varying cross-sectional diameters. The biasing resistance provided by these cords varies with the individual cord's cross sectional diameter. By placing various combinations of these cords over the securing pins, the user can obtain a wide range of resistance to execise movements.

With the lever arm biased against upward movement, the user can perform such exercises as bench presses, military presses, leg presses, shoulder shrugs, or other traditional exercises by simply adjusting the position of the carriage (as previously described) and attaching a desired amount of resistance.

By removing, inverting, and reattaching the carriage/lever arm assembly the lever arm may be biased against downward movement as shown in FIG. 8, allowing the performance of pulling exercises such as bicep curls, tricep pushes.

A problem often encountered on portable exercise devices is that when performing traditional pulling exercises, the user's body tends to lift from the ground when the resistance approaches body weight, thus limiting the effective range of the exercises being performed. The present device features an adjustable retaining belt (47) which fastens over the user's legs or feet, preventing the user's body from lifting and thereby allowing the use of exercise resistance equal to or greater than the body weight of the user. The adjustable retaining belt is attached to the platform by securing L-shaped pins through the belt ends into the platform's pin receiving means (64) as previously described herein.

FIG. 7 shows the device in another preferred embodiment. The exercise bar (5) has been connected to the exercise platform (48) at a position which lifts one end of the platform, forming an inclined exercise surface supported on one end by the side wall of the case half and on the other end by the exercise bar. In this configuration, inclined situps may be performed. A knee support unit (49) is slidably attached to the exercise bar so as to maintain the user's knees in a flexed position thereby positively isolating the abdominal muscles for exercise. This feature is unique in the art and virtually assures that sit-ups will be performed in a manner which will strengthen the abdominal muscles.

As shown in FIGS. 17 & 18, the knee support unit (49) consists of a rectangular aluminum frame having a section of U-shaped aluminum channel (50) welded so as to bisect the frame across its width. The channel includes ears (51) through which transverse coaxial apertures (52) are drilled. Through the apertures (52) a securing pin (53) passes, also passing through an aluminum sleeve (54). Both the securing pin and the sleeve are attached to the channel by welding. On the surface of the aluminum frame opposite the channel, a vinyl-covered foam pad (55) is attached by gluing and/or riveting in order to provide comfort to users. Transverse coaxial apertures (56) are drilled into the sides of the U-shaped channel as shown. These apertures are alignable with the apertures on the exercise bar. Attachment of the knee support unit (49) to the exercise bar (5) is accomplished by passing an L-shaped fastening pin (57) through the aligned apertures in the exercise bar in the manner previously described. For convenience, the L-shaped pin is also permanently attached to the knee support unit.

Another embodiment shown in FIG. 11 allows the performance of leg exercises, bicycling, rowing, and combinations of these by adding a variety of components to this basic configuration which will be referred to hereinafter as the basic horizontal configuration (58). The case halves have been disconnected and placed on edge such that the exercise bar support openings (1) and (2) are up. The exercise bar (5) is disposed horizontally, one end being inserted into the closed exercise bar support and secured by the pin fastening means as previously described, and the other end of the bar being inserted into the open exercise bar support and similarly secured. A seat component (59) is attached to the exercise bar as shown. The seat, as seen in FIGS. 15 and 16, is comprised of a triangular shaped aluminum frame. A section of U-shaped aluminum channel (60) is welded to the lower surface of the triangular frame such that it bisects the apex of the triangular frame and centers on its base. Transverse coaxial apertures (61) are drilled in the side walls of the channel which, when aligned with the apertures in the exercise bar (5) allow the seat to be adjustably connected via a pin fastening means. The pin fastening means, similarly to those previously described, consists of an L-shaped fastening pin (62), capable of passing through the aligned apertures in the seat frame and the exercise bar. The pin (62) is also permanently fastened to the seat component as shown. Foam padding is attached to the upper portion of the frame to provide comfort for the seated user.

To perform hamstring curls and quadracep extensions, the knee support unit (49) and the carriage/lever arm assembly (23) are attached to the basic horizontal configuration with the lever-arm disposed below the plane of the exercise bar as shown in FIG. 14. Attachment of these components is easily accomplished by detaching the exercise bar at the open exercise bar support, lifting the exercise bar upward from the case half, and sliding first the knee support unit and then the carriage/lever arm assembly over the unattached end of the exercise bar. The exercise bar is then reattached to the case half at the open exercise bar support. The user can then move the knee support unit and the carriage/-lever arm assembly into a proper and comfortable position, securing them in place by their respective pin fastening means as previously described. The biasing means may now be alternately attached to the securing pins on the carriage/lever arm and the knee support unit so as to provide resistance against movement either back towards toe user (allowing the performance of hamstring curls) or away from the user (thus allowing the performance of quadracep extensions. Cylindrical foam pads (63) are provided which are positioned over the ends of the lever arm handle. These pads protect and comfort the ankles and legs of users during the performance of leg exercises.

To perform rowing exercises, the carriage/lever arm assembly (23) is attached to the basic horizontal configuration (58) by the pin fastening means as previously described such that the lever arm is disposed above the plane of the exercise bar as shown in FIG. 12. The knee support unit is then attached to the exercise bar such that it is positioned between the carriage/lever arm assembly and the open exercise bar support. Biasing means are attached as shown. The user performs a rowing-like exercise by sitting on the seat, grasping the lever-arm handle (38), and pulling it towards himself while supporting the feet against the proximal edge of the knee support unit (49).

It will be apparent that other attachments, such as a bicycling apparatus, shown in FIG. 13, may be easily fabricated and attached similarly to other components.

The device has been described in its several embodiments and combinations thereof. However, to one skilled in the art, several modifications and/substitutions could easily be made without departing from the spirit of the invention. For example, other materials could be substituted for the aluminum which is herein described as the primary material of construction; another method of connecting the two case halves together could be employed; and other means of resistance could be utilized including hydraulic systems. Therefore, the scope of the invention is limited only by the following claims:

I claim:

1. A fully contained, fully transportable, multi-configurable apparatus for physical exercises of the upper and lower body comprising:

a first rigid case half of substantially rectangular shape having an open receiving means for receiving and adjustably attaching an exercise bar in a plurality of positions, a second rigid case half of substantially rectangular shape having an enclosed receiving means for receiving and adjustably attaching an exercise bar in a plurality of positions, wherein the rigid case halves are detachably secured together to form a case which when closed forms a hollow compartment for the storage of components of the exercise apparatus, wherein the components include;

a multi-sectional exercise bar wherein said bar is adjustably attachable to the said rigid case halves in horizontal, vertical, or diagonal configurations, various exercise components and means for attaching said components to said exercise bar, a means of attaching said the rigid case halves together to form a single flat base member for use as a body support when the exercise bar is supported either vertically or diagonally, a second means of attaching said rigid case halves to opposite ends of said exercise bar to form a two-sided ground supported base member for various embodiments, wherein the exercise bar is horizontally supported above the ground in a position to receive exercise components, a removably and adjustably attachable support device for enhancing the use of the apparatus by maintaining the users knees in a proper position during some exercises and for supporting the user's body during other exercises, a removably and adjustably attachable seat component for supporting the users body during some exercises.

* * * * *